US012543866B2

(12) United States Patent
Obriot

(10) Patent No.: US 12,543,866 B2
(45) Date of Patent: Feb. 10, 2026

(54) BREATHABLE BASSINET STRUCTURE

(71) Applicant: Kelly M. Obriot, Allen Park, MI (US)

(72) Inventor: Kelly M. Obriot, Allen Park, MI (US)

( * ) Notice: Subject to any disclaimer, the term of this patent is extended or adjusted under 35 U.S.C. 154(b) by 0 days.

(21) Appl. No.: 18/746,497

(22) Filed: Jun. 18, 2024

(65) Prior Publication Data

US 2025/0380823 A1 Dec. 18, 2025

(51) Int. Cl.
*A47D 9/00* (2006.01)

(52) U.S. Cl.
CPC ..... *A47D 9/016* (2022.08)

(58) Field of Classification Search
CPC ..... A47D 15/001; A47D 9/016
USPC ..... 5/93.1
See application file for complete search history.

(56) References Cited

U.S. PATENT DOCUMENTS 4,146,885 A * 3/1979 Lawson, Jr. ..... G08B 21/22 5/655
5,561,876 A * 10/1996 Petruzella ..... A47D 15/001 5/724
5,664,273 A * 9/1997 Obriot ..... A47D 15/001 5/724
5,699,571 A * 12/1997 Yowell ..... A47D 15/001 5/724
5,857,232 A * 1/1999 Mahdavi ..... A47D 15/001 5/724
6,560,795 B2 * 5/2003 Hsia ..... A47D 13/06 5/724
7,614,098 B1 * 11/2009 Quarry ..... A47D 15/008 24/711.1
8,607,390 B2 * 12/2013 Obriot ..... A47D 9/00 5/724
8,745,780 B2 * 6/2014 Su ..... A47D 9/012 312/301
8,935,821 B2 1/2015 Obriot
9,986,849 B2 * 6/2018 Sclare ..... A47D 9/016
10,470,586 B2 * 11/2019 D'Urso ..... A47D 15/003
2004/0261174 A1 * 12/2004 DeHart ..... A47D 9/016 5/98.1
2012/0180217 A1 * 7/2012 Obriot ..... A47D 15/008 5/604
2013/0198957 A1 * 8/2013 Obriot ..... A47D 15/001 5/604
2014/0310870 A1 * 10/2014 Czach ..... A61G 12/001 5/11
2017/0105548 A1 * 4/2017 D'Urso ..... A47C 23/24
2018/0220809 A1 * 8/2018 D'Urso ..... A47D 15/003
2020/0359814 A1 * 11/2020 Myers ..... B32B 3/08

* cited by examiner

*Primary Examiner* — J. T. Newton
(74) *Attorney, Agent, or Firm* — Young Basile Hanlon & MacFarlane, P.C.

(57) ABSTRACT

A molded plastic bassinet body holds a bedding structure on a horizontal molded-in shelf above a stepped-in lower body portion wherein the bedding structure is formed of two spaced apart parallel layers of open weave material such that an infant placed upon the bedding structure and laying in a face down position can breathe through the bedding structure. There is no fill between the two layers. The sleeve is mounted on a tubular frame pivotally mounted within the bassinet body and spaced above the floor. Openings are provided in the side walls of the stepped-in lower body portion below the bed structure to permit the in flow and out flow of air therethrough. The bassinet may be carried by a wheeled cart in hospital venues.

7 Claims, 5 Drawing Sheets

BREATHABLE BASSINET STRUCTURE

INTRODUCTION

This document describes a bassinet structure for infants that allows an infant to breathe through the bedding material when lying face down within the bassinet and further permits easy disassembly and reassembly for cleaning.

BRIEF DESCRIPTION OF THE INVENTION

Briefly described, the bassinet structure comprises a generally rectangular body which is preferably but not necessarily formed integrally from a moldable polymeric material such as quarter inch thick clear acrylic so as to have parallel left and right sidewalls, a head wall and a foot wall together with a solid bottom forming a tub-like vessel with an open top. In addition, the body is formed with a step part way between the top rim and the bottom to form an integral frame shelf on and extending around the interior walls and uniformly spaced inches above and generally parallel to the bottom plane of the bassinet. As a result of the stepped structure, the bottom portion of the bassinet vessel has smaller length and width dimensions than the upper portion. A bedding structure including a tubular frame and a sleeve made of two different layers of breathable materials rests on the internal shelf when in use. One end of the frame may be connected to spring clips attached to the bottom in alignment with pockets interrupting the shelf in the sides of the bassinet to allow the frame to be placed in a stand-up position thereby to facilitate removal and replacement of the bedding sleeve.

The tubular stainless-steel frame (which can be powder-coated metal) in the bedding structure is generally rectangular but with rounded corners and of such size as to fit within the interior of said bassinet body and on the frame support shelf described above. The size of the frame is such as to extend fully between the upper side walls and fully between the head and foot walls; i.e., it has essentially the inside dimensions as the inside surfaces of the upper portion of the bassinet vessel. The tube diameter is ¾ inch in the disclosed embodiment.

The structure further comprises a sleeve of breathe-through fabric materials consisting of a top layer made of an open weave polyester material, often called a "spacer fabric", and a bottom layer made of an open weave Nylon. Exemplary compositions of the sleeve materials are described in more detail in my U.S. Pat. No. 8,935,821 issued Jan. 20, 2015, the entire disclosure of which is incorporated herein by reference. The two layers are joined together along the sides and bottom edges to form a sleeve or envelope with a generally open flapped top that permits the sleeve to slide onto and be held by the tubular frame such that the spacing between the two layers is defined by the diameter of the tubular frame. which in the preferred embodiment is on the order of ¾ in. The space between the two layers of the sleeve is unfilled so as to permit an infant to breathe freely through the two layers of the sleeve when and if lying in a face down condition. The tension in the sleeve materials is such as to maintain spacing between the two layers when an infant is lying on the top layer.

In addition, the bassinet structure has openings formed, for example, in at least one side wall below the inward step so as to permit the free flow of air into and out of the space below the sleeve and tubular frame when assembled and installed on the interior of the bassinet. An upper side wall of the bassinet vessel may have a bottom-hinged access door to facilitate placing and/or removing an infant into or from the bassinet. The shape of the bassinet body is such as to easily fit onto a wheeled cart for institutional use.

DETAILED DESCRIPTION THE ILLUSTRATIVE EMBODIMENT

Figure 1:
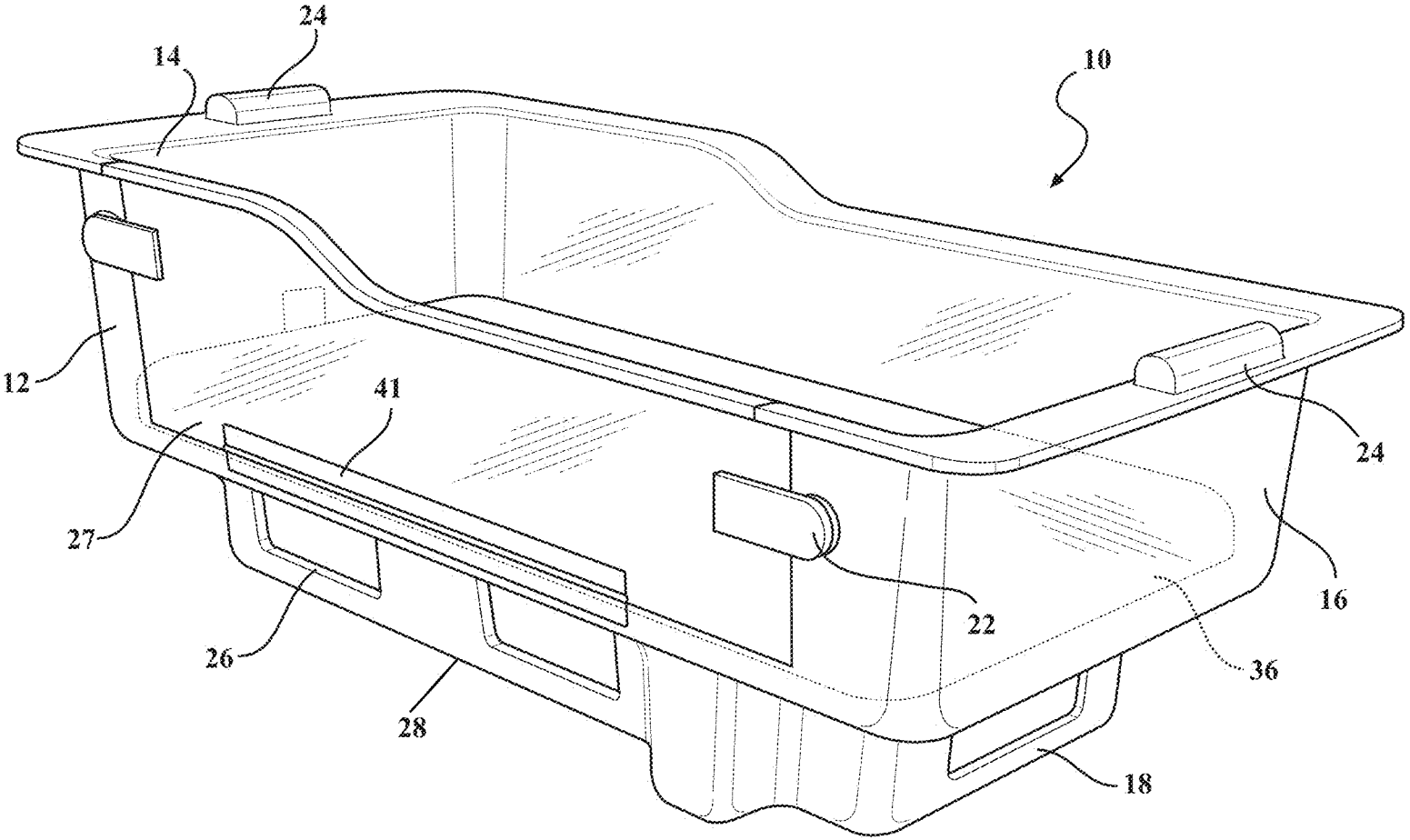
FIG. 1 is a perspective view of an exemplary bassinet structure with a bedding assembly installed therein.

Referring to the drawing FIGS. 1-4, a bassinet body 10 of molded plastic construction is shown to be in the shape of an open top generally rectangular vessel having opposite parallel sidewalls 12, a head wall 14 and a foot wall 16 defining an enclosure of such size to accommodate or fit an infant, all of which are stepped inwardly at the lower edges to form thereon a lower body portion 28 with a floor 18. The side walls are formed with a somewhat higher portion 20 near the head wall 14. The sides of the inwardly stepped lower portion 28 have a plurality of openings 26 formed in all four side surfaces as shown for purposes to be described.

The bassinet body 10 may be made from any of a variety of moldable polymeric materials including but not limited to acrylic plastic One upper sidewall portion has an access panel 27 formed therein with a plastic bottom hinge 41 together with latch structures 22 at the left and right sides thereof. The function of the access panel 27 is to facilitate placing an infant on a bedding structure 36 which is removably placed in a horizontal position within the body 10 on the shelf 43 formed by the inward step in the side, head and foot walls as described above.

Figure 6:
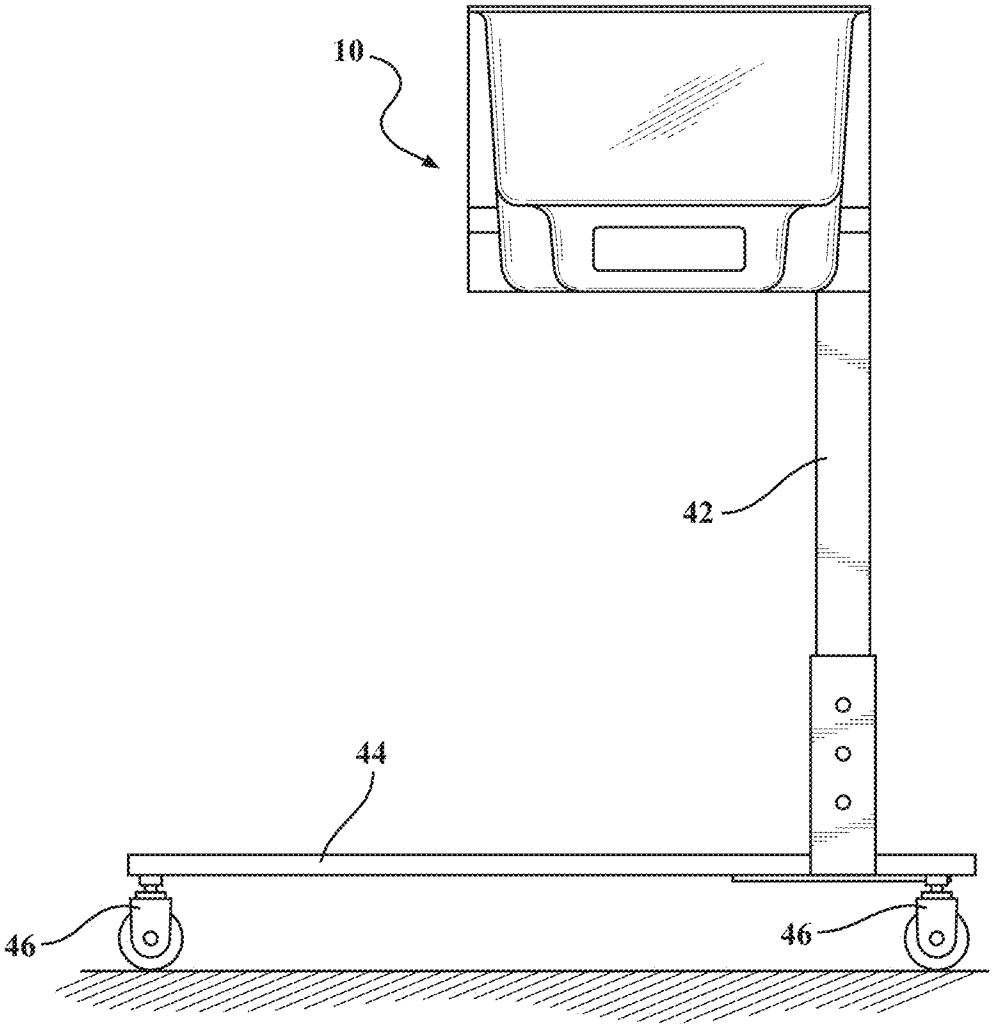
FIG. 6 is a side view of the bassinet attached to a representative cart structure.

The body 10 is provided with top and bottom handle structures 24 which are integral with the head and foot walls 14 and 16 respectively for lifting a carrying the bassinet 10 from place to place as desired and/or placing it on a cart as shown in FIG. 6.

Figure 2:
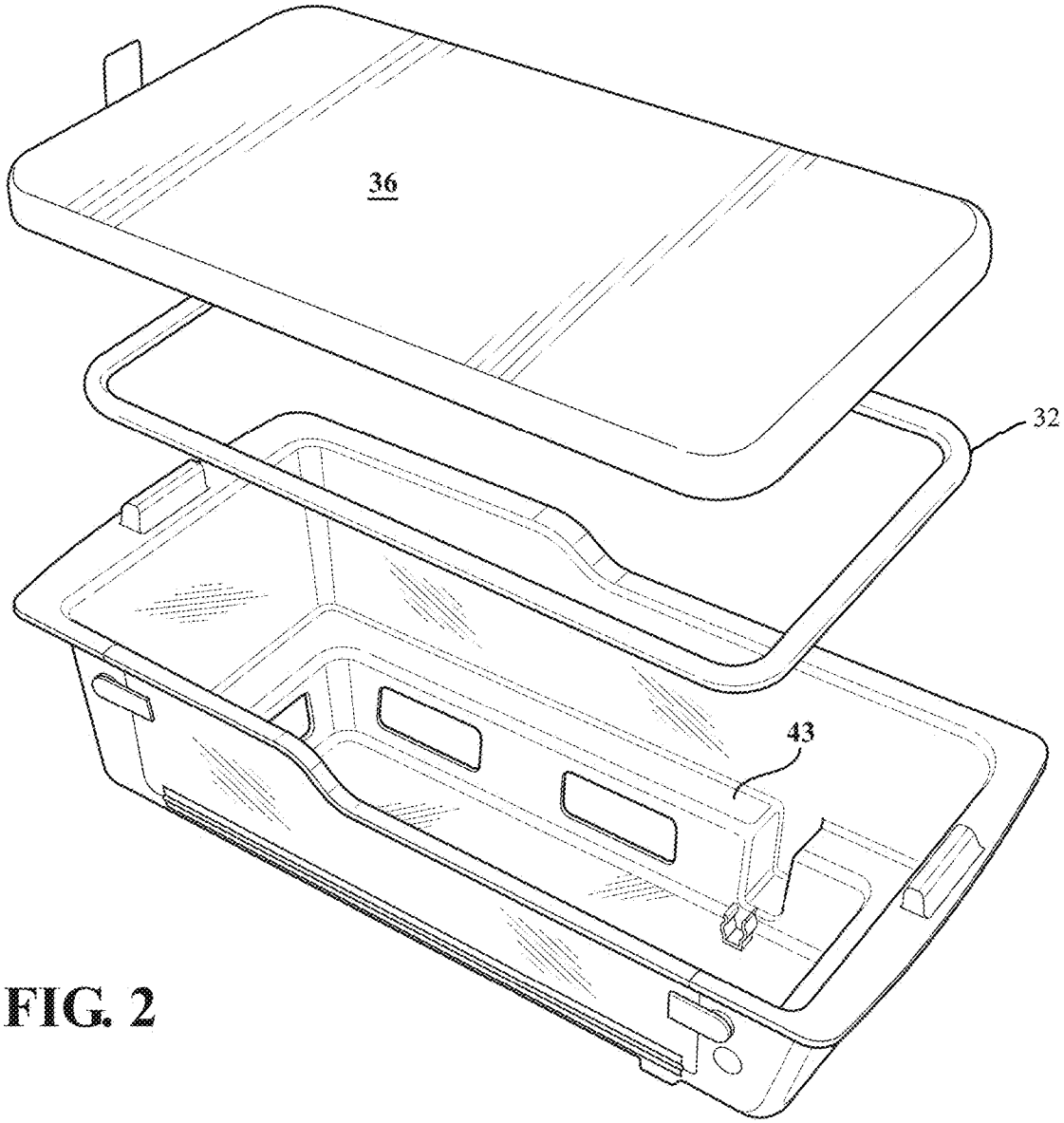
FIG. 2 illustrates the bassinet structure in exploded form to better see the components thereof.
Figure 3:
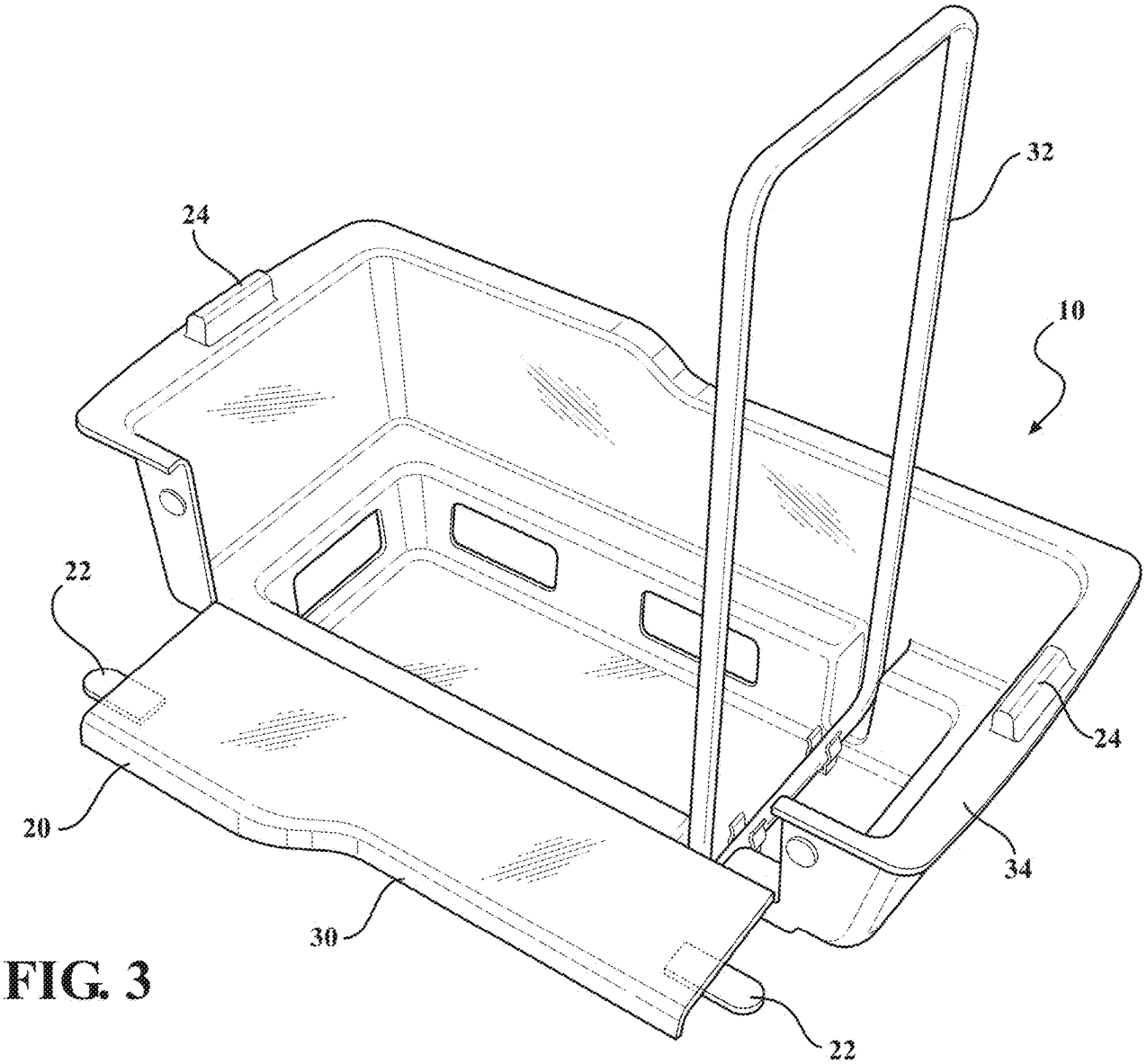
FIG. 3 shows the bassinet with the tubular bedding frame hinged upward for access and a side panel door hinged open.

As best shown in FIGS. 2 and 3, the inwardly stepped structure results in an interior shelf 43 formed integrally with the bassinet body 10 and internally thereof to extend fully around the rectangular interior uniformly spaced approximately 8 inches below the upper rim of the body to provide support for a tubular metal frame 32 with rounded corners which is hingedly attached to the bottom of the body 10 by means of stainless steel spring clips 47 that are attached by screws or rivets to the floor panel 18. As best shown in FIGS. 2 and 3, the shelf 43 is interrupted on both sides to create pockets 45 of the same lateral dimension as the upper portion of the bassinet vessel to accommodate the full-width frame and allow the frame 32 to reach the floor mounted clips 47 to receive and releasably hold frame upright in the bassinet. This method of attachment allows the rectangular stainless frame 32 to be re-mounted or taken from its normal horizontal position resting on the support shelf 43 as shown in FIG. 1 to an upright or vertical position as shown in FIG. 3 for installation and removal of a sleeve 28 of two-part breathable material which is placed over the frame 32 to form the bedding structure 36. The access panel latches 22 and the hinge 41 are all made, for example, of plastic to be washable without degradation or damage. The material for the frame 32 is polished stainless steel or powder coated metal to withstand repeated washings and sterilization for maintenance of the bassinet for long term use.

As best shown in FIGS. 1, 2 and 3 the openings 20 in at least the lower sidewall 12 are below the shelf and the plane of the bedding structure 36 when mounted on the shelf within the bassinet body so as to permit free air flow in and out of the lower portion of the bassinet body and below the bedding structure as this is essential to maximize the benefits provided by the construction of the bedding structure using breathable materials as hereinafter described.

Figure 4:
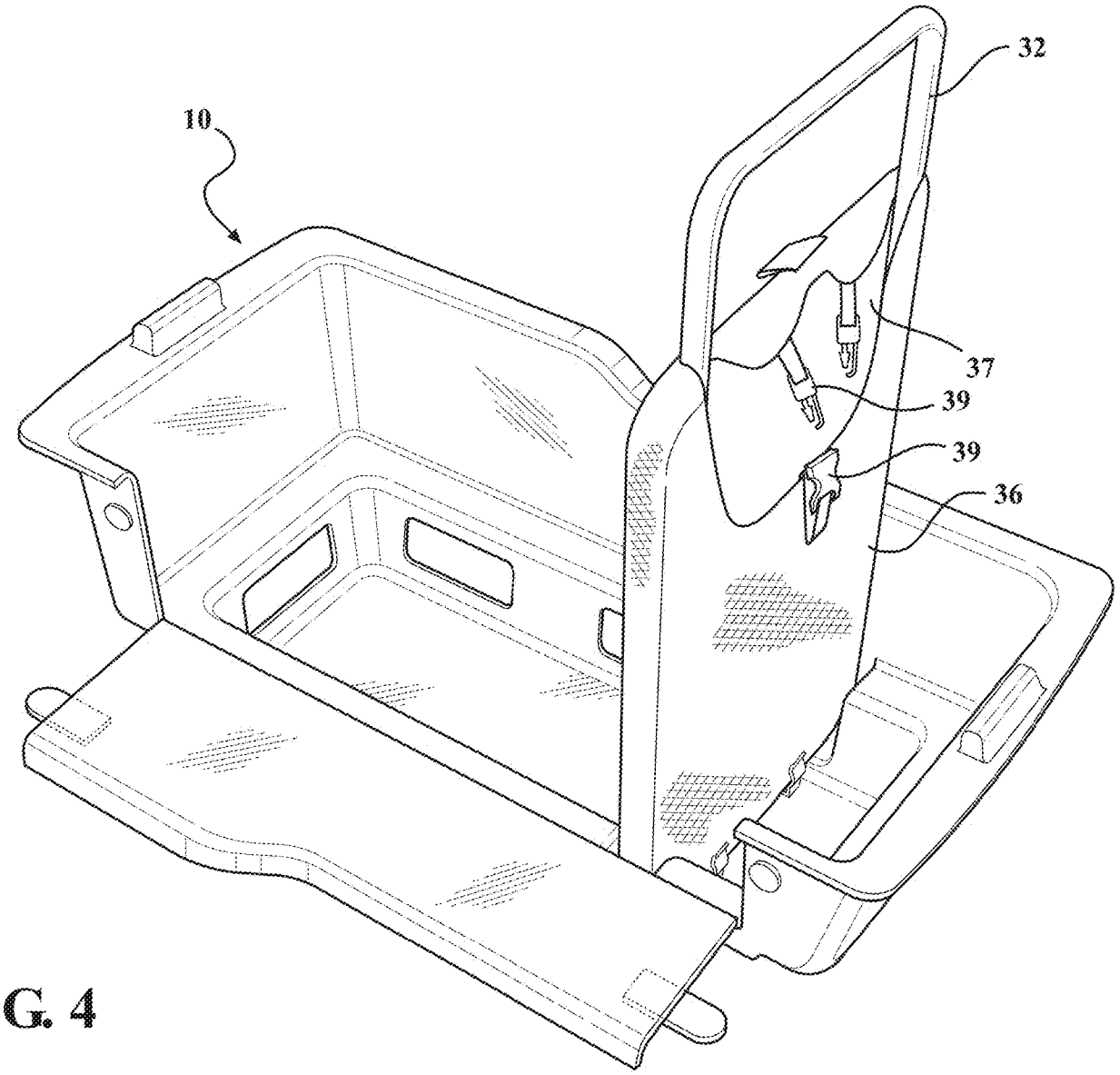
FIG. 4 shows the bassinet with a bedding sleeve installed on the tubular bedding frame.
Figure 5:
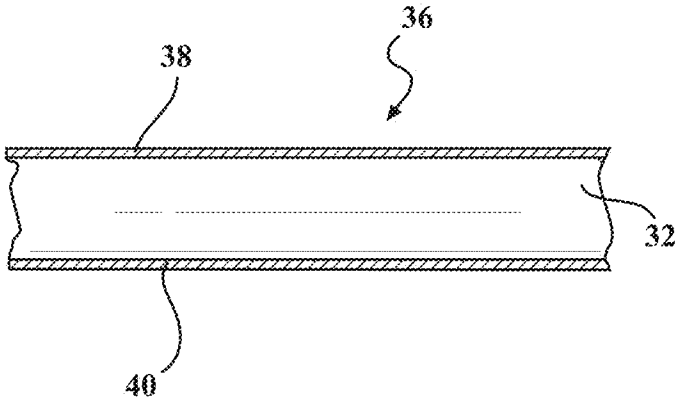
FIG. 5 is a cross section of a portion of the bedding assembly showing the two material layers thereof.

Looking now to FIGS. 2, 4 and 5, the bedding structure 36 comprises the tubular frame 32 and a sleeve 37 consisting of a top layer 38 made of a woven open weave polyester material called a "spacer fabric" whereas the bottom layer 40 is made of a commercially available open weave Nylon material. There is no filler between the top layer 38 and the bottom layer 40 thus making the entire bedding structure capable of freely passing air completely therethrough so that an infant resting on the bedding structure face down can breathe through the layers 38 and 40 and draw air from the volume below the bedding structure 36 in the bassinet by virtue of the opening 20 formed in the sidewall 12. The plane of the bedding structure 36 is approximately 4 inches above the floor 18 but it is to be understood that the dimensions given herein are by way of example rather than limitation.

The sleeve on the bedding structure is fabricated by conjoining or sewing together the sides and bottom areas where the two materials 38 and 40 match dimensionally (i.e., are aligned). The top is left unsewed to allow the sleeve to slide onto and off of the frame tube. The top end of layer 38 is formed with a flap 37 which is structured to pass between the sides of the frame 32 and over the top of the bedding structure so as to extend down and over a portion of the lower layer 40 as best shown in FIG. 4. Latch structures 39 are provided to secure flap 37 in place. The flap can be removed to essentially open the top of the sleeve and permit it to be removed from frame 32 for cleaning and/or replacement thereof.

FIG. 6 illustrates a typical hospital use of the bassinet structure 10 by placing it on a cart 42 having a base structure 46 with wheels 48 to permit the bassinet structure to move from place to place with or without an infant therein.

Exemplary dimensions for the bassinet body are as follows: overall length is 33.3 inches; overall width is 16 inches; depth is 12 inches; side openings in lower body are 6.625 by 1.75 inches.

What is claimed is:

1. A bassinet structure for infants comprising:

a bassinet body having integral bottom, side, head and foot walls defining a generally rectangular enclosure with an open top and of such size as to accommodate an infant therein;

an interior of said side walls together having formed thereon a frame support shelf uniformly spaced above said bottom;

a generally rectangular tubular frame sized to fit fully within the interior of said bassinet and onto said frame support shelf so as to be spaced above the bottom of said bassinet; and a bedding structure on said frame comprising an open weave fabric top layer and an open weave bottom layer wherein said layers are conjoined along edges and bottom to form a sleeve with an open top end to allow said sleeve to slide onto and be taken off of said tubular frame;

the open weave fabrics being woven so as to freely pass air therethrough; and wherein the frame support shelf is interrupted at aligned positions on both side walls to create pockets with a width of an upper bassinet body and extending to a floor to allow the frame to be re-mounted from a horizontal position within the bassinet body to a vertical position wherein an end of the frame extends into each of said pockets.

2. The bassinet structure defined in claim 1 wherein at least one side wall of said bassinet has openings formed therein below said support shelf to permit free air flow into and out of the space within said bassinet under said sleeve when the frame and sleeve is placed on frame support shelf within the interior of said bassinet.

3. The bassinet structure defined in claim 1 wherein said body side walls are inwardly stepped between the top and bottom to form said frame shelf around the interior of said bassinet walls including the head and foot walls.

4. The bassinet structure defined in claim 1 wherein the tubular frame is rectangular and has rounded corners.

5. The bassinet structure defined in claim 1 wherein a side wall of the bassinet has a hinged access panel formed therein.

6. The bassinet structure defined in claim 1 further including a cart supporting the bassinet structure.

7. The bassinet structure defined in claim 1 wherein spring clips are mounted on the floors of said pockets to receive and releasably hold said frame in said vertical position.

* * * * *